United States Patent [19]

Erickson

[11] 4,299,64(

[45] Nov. 10, 198

[54] RUBBER-BRASS ADHESION IMPROVED THROUGH TREATMENT OF THE METAL WITH AMINO CARBOXYLIC ACID OR SALT THEREOF

[75] Inventor: David E. Erickson, Stow, Ohio

[73] Assignee: The General Tire & Rubber Company, Akron, Ohio

[21] Appl. No.: 172,322

[22] Filed: Jul. 25, 1980

[51] Int. Cl.[3] ..... B29H 9/08; B32B 15/02; B32B 15/06

[52] U.S. Cl. ..... 156/110 C; 134/2; 134/3; 152/359; 156/117; 156/281; 156/307.5; 156/316; 156/629; 156/307.7; 252/79.1; 427/307; 428/380; 428/390; 428/462; 428/465

[58] Field of Search ..... 134/2, 3; 152/359; 156/110 C, 281, 307.5, 307.6, 316, 629, 117; 252/79.1; 428/390, 379, 380, 462, 465; 427/307

[56] References Cited

U.S. PATENT DOCUMENTS 2,318,559 5/1943 Percival ..... 134/

FOREIGN PATENT DOCUMENTS 1532057 7/1968 France ..... 134/

OTHER PUBLICATIONS

Downey, "Metal Finishing", 60 (10), Oct. 1962, pp 50–57 and 65.

Van Ooij, "Rubber Chemistry and Technology", 52 (3) Jul.–Aug. 1979, pp. 605–675.

*Primary Examiner*—James C. Cannon

[57] ABSTRACT

The adhesion of brass plated steel cord to rubber i improved in many cases by treatment of the cord wit a dilute aqueous solution of certain amino carboxyli acids and their corresponding ammonium, lithium, sc dium and/or potassium salts and salt hydrates. Afte dipping in the treating solution, the cords may be rinse with water, dried, combined with a vulcanizable rubbe compound and vulcanized.

20 Claims, No Drawings

RUBBER-BRASS ADHESION IMPROVED THROUGH TREATMENT OF THE METAL WITH AMINO CARBOXYLIC ACID OR SALT THEREOF

This invention relates to the adhesion of rubber to brass, and more particularly, it relates to the adhesion of rubber to brass plated steel wire tire cord.

Applicant's copending U.S. patent application filed May 15, 1980, Ser. No. 150,103, and entitled "Adhesion of Brass to Rubber" discloses a process of treating brass with aqueous solutions of ammonium, Na, K and other salts of saturated aliphatic carboxylic acids of 1 to 5 carbon atoms to improve the adhesion of the brass to rubber.

Applicant's copending U.S. patent application filed May 22, 1980, Ser. No. 152,235, and entitled "Adhesion of Rubber to Brass" discloses a process of treating brass with a dilute acidic alcoholic solution followed by $H_2S$ gas treatment, or with a dilute aqueous ammonia solution, preferably followed by $H_2S$ gas treatment, to improve the adhesion of brass to rubber.

BACKGROUND OF THE INVENTION

The bond between brass and rubber is believed to involve the formation of a thin layer of cuprous sulfide. During compounding and fabrication of the tire, the rubber picks up a small amount of water. Moreover, the presence of a layer of zinc hydroxide and/or oxide on the surface of the brass before use or the formation of zinc hydroxide and/or oxide by water in the rubber reacting with metallic zinc, leads to the very rapid growth of the cuprous sulfide layer and/or the formation of more zinc oxide and/or hydroxide. Some cuprous oxide, also, may be in these outer layers of the brass coating. These reactions are accelerated by the heat developed during operation of the tire. Thus, there is formed a relatively thick friable or weak layer of corrosion products where debonding can occur in said layer or between said layer and the brass and/or rubber strata.

Accordingly, it is an object of the present invention to overcome the difficulties alluded to above and to provide a method of treating brass to improve its adhesion to rubber.

A further object is to increase the resistance of the rubber-brass bond to degradation caused by heat and the presence of moisture.

Another object is to provide a brass-rubber composite exhibiting an improved brass-rubber bond.

Yet another object of this invention is to provide brass with a surface which is more amenable to bonding to rubber.

These and other objects and advantages of the present invention will become more apparent to those skilled in the art from the following detailed description and working examples.

SUMMARY OF THE INVENTION

According to the present invention it has been found that the corrosion products on brass plated steel cord in many instances can readily be removed by treatment of the cord with dilute aqueous solutions of amino carboxylic acids or their corresponding ammonium, lithium, sodium and/or potassium salts and salt hydrates. After dipping in the treating solution the cord may be rinsed in water, dried and combined with a vulcanized rubber compound and vulcanized. Adhesion tests of the treated cords in many instances show improvements in tl unaged and humid aged strengths of the brass plate steel cord to rubber.

It is believed that the improved results in adhesion ai obtained because the dip of the aqueous amino carbo: ylic acid solution removes an outer surface layer(s) ( oxide(s) and/or hydroxide(s) especially of zinc an increases the ratio of copper to zinc in the outer surfac layer(s) of the brass plating on the steel cords. Sorr copper oxide, also, may be removed by the treatmen Thus, a fresh or new brass surface is provided which more amenable to bonding to rubber.

DISCUSSION OF DETAILS AND PREFERREI EMBODIMENTS

Brass plated steel tire cords (wire) are well known fc use in the belts and carcasses of passenger, truck an off-the-road tires and for other purposes like belts. Tl wire may be woven or non-woven filaments of stee and the wire or cords when used in tires is usually calle a fabric. The steel may be dipped, electroplated or otl erwise coated with the brass as is well known. The bra: plating should be complete although some iron may b exposed on commercially brass plated steel cords. Usi ally the brass is deposited as a thin coating on the stee usually not over about 1.2% by weight of the steel. Tl brass may contain from about 60 to 95% by weight ( copper, preferably from about 62 to 72% by weight ( copper, and even more preferably in the upper portic of this range to obtain higher adhesion, the balanc being essentially zinc except for very minor amounts ( other elements or compounds as adventitious or allo ing materials. For more information on brass please se "Encyclopedia Of Chemical Technology," Kirl Othmer, 2nd Ed., Vol. 6, pages 183 to 265, 1965, Inte science Publishers, a division of John Wiley & Son Inc., New York.

The amino carboxylic acids have from 2 to 24 carbc atoms, from 1 to 4 nitrogen atoms and from 1 to 6 aci or carboxylic acid groups. The corresponding amm nium, lithium, sodium and/or potassium salts and the salt hydrates may be used. Examples of such amin carboxylic acids are glycine (preferred), amino butyr acid, gamma amino butyric acid, sodium lauroyl sarc sinate, sarcosine, ethylene diamine tetraacetic acid, etl ylene diamine tetraacetic acid disodium salt dihydrat iminodiacetic acid, nitrilotriacetic acid, the disodiu salt of nitrilotriacetic acid, sodium para-aminobenzoat diethylene triamine pentaacetic acid, hydroxyethyl etl ylene diamine triacetic acid, triethylene tetraamine he aacetic acid, 1,3-diamino-2-propanol tetraacetic aci 1,2-propylene diamine tetraacetic acid, ethylene d amine diacetic acid, symmetrical ethylene diamine d acetic acid disodium salt, hydroxyethyl glycine sodiu salt, iminodiacetic acid disodium salt, N-methylimino cetic acid disodium salt, oleyl sarcosine, ethylene d amine tetraacetic acid tri sodium salt monohydrate an ethylene diamine tetraacetic acid tetra sodium salt dih drate. Mixtures of the amino carboxylic acids, their sal and salt hydrates can be used. Aliphatic amino carbo ylic acids are preferred. These amino carboxylic aci have been known as chelating agents and surfactants.

The amino carboxylic acid is used in an amount ( from about 0.5 to 6.0% by weight in water. Ammoniu hydroxide, lithium hydroxide, sodium hydroxide an /or potassium hydroxide may be used to increase tl solubility of the amino carboxylic acids in the wat and/or to change the pH of the dip solution. Also, it ıreferred that the pH of the aqueous solution of the mino carboxylic acids be from about 7 to 11.5.

The brass plated steel cords are dipped in the dipping ath or solution for a period of time and at a tempera- ıre sufficient to remove all or at least an appreciable mount of the corrosion products, such as oxides and ydroxides of copper and zinc and so forth, on the urface of or in the outer surface layers of the brass to nprove the adhesion of the brass to the rubber. The ıme may vary from a few seconds to several minutes or ıore depending on the temperature, concentration and ɔ forth. It is preferred to operate at about room tem- erature (ca 25° C.) to avoid loss of water, treating gent and so forth although in a properly sealed or ther apparatus designed to limit loss of water and treat- ıg agent or to permit its recovery, higher temperatures ıay be used.

After dipping the cords are desirably rinsed (dipped r washed) in water for a time and at a temperature ıfficient to remove the treating solution and by-pro- ucts or the products of the reaction of the treating ɔlution with the surface of the brass coated cord. Tem- eratures should desirably be at about room tempera- ıre to prevent loss of the rinsing medium but higher ɜmperatures can be utilized as set forth above if suitable recautions are taken.

The cords after rinsing are dried in nitrogen or other ıert gas or in air provided the moisture content is low, referably the gas or air should be dry, at temperatures ıfficient to remove the solvents and other treating ɔlution without formation of any appreciable amount f Cu or Zn oxides and/or hydroxides. Drying tempera- ıres preferably may vary from about 25° to 200° C.

The treated cord can be combined (calendered, oated, laminated and so forth) with a curable rubber ompound and cured (vulcanized). Alternatively, the ord may be stored such as in an inert or dry atmo- ɔhere until needed for use.

The rubber to which the treated cord is to be bound preferably natural rubber or polyisoprene. However, lends thereof with other rubbery polymers like rub- ery butadiene-styrene copolymers and/or polybutadi- ne can be used. For products other than tires there can e used nitrile rubber, polychloroprene and so forth. 'hese rubbers can be suitably compounded with carbon lack, silica (preferably dried), zinc oxide, stearic acid, ntioxidants, accelerators, resins, sulfur and so forth.

Brass plated steel tire cords treated according to the resent invention can be used in the belts and carcasses f passenger, truck and off-the-road tires, in belts and ose and for other purposes.

The following examples will serve to illustrate the resent invention with more particularly to those cilled in the art.

In these examples to test the treated cords, the speci- ıen cords were cut and without a solvent wash were nbedded in a rubber compound. The rubber com- ɔund was $\frac{5}{8}$" thick and backed with metal strips to ɜduce rubber deformation. The single end pullout ɔrce was measured on an Instron tester at 5 inches per inute using a special slotted jig to hold the sample Coates and Lauer, "Rubber Chemistry & Technol- gy," 1972, Vol. 45, No. 1, page 16). Each sample con- ined 16 cords. Also, humid aging tests were carried ut on the sample after every other wire had been ılled (in other words after half the wires were pulled, ıe sample was humidity aged and then the remaining ires were tested), or on alternative samples. In any event, the reported values for adhesion are the average of 16 pulls and are reported in Newtons (N). The samples of the rubber compounds containing the wire cords embedded therein were cured in a mold at a temperature and for a period of time as indicated.

For humidity aging the rubber samples containing the embedded cords were placed in aluminum cylinders containng 100 cc of liquid water at the bottom of the cylinder, purged with nitrogen 3 times and sealed. The samples were on a screen in the cylinder above the liquid water. The sealed cylinders containing the samples, water and nitrogen were then aged for 72 hours in a hot air oven at 121° C. After this period of time, the samples were removed from the oven and from the cylinders and stored wet in bags until testing which was conducted within a few hours after removal from the oven.

Adhesion tests for the unaged and humid aged samples were conducted at room temperature (about 25° C.).

The rubber compound or stock used to make the samples for the adhesion tests comprised the following ingredients:

| Ingredient | Parts by Weight |
|---|---|
| Natural rubber | 100 |
| HAF carbon black | 30 |
| Silica ("Hi-Sil," precipitated, hydrated silica, PPG Industries, Inc.) | 15 |
| Zinc oxide | 10 |
| Stearic acid | 1.5 |
| N-(1,3-Dimethylbutyl)-N'-phenyl-p-phenylenediamine ("Santoflex" 13, Monsanto, Organic Division Rubber Chemicals) | 2 |
| "Cohedur" RL, 1 to 1 parts by wt. mixture of resorcinol and "Cohedur" A, which is the pentamethyl ether of hexamethylol melamine, with a small amount of dibutyl phthalate plasticizer for viscosity control. Naftone, Inc. | 4.6 |
| N-dicyclohexyl-2-benzothiazole sulfenamide ("Vulkacit" DZ, Mobay Chemical Co.) | 1.3 |
| Sulfur (Rubbermakers Grade) | 3.0 |

EXAMPLE I

Bekaert and Enka Z brass plated steel wire tire cords (both 7×4×0.20 mm, 6±2 g brass/kg of wire, 67.5%±3.5% copper in the brass) were treated for 48 seconds in the dipping solution at room temperature which was followed by a 40 seconds washing step in water at room temperature and further followed by a 110 seconds drying step in air at 177° C. The treated cords were allowed to cool and then were combined with the ruber compounds as shown above and cured at 153° C. for 35 minutes. The details of the runs and results obtained are shown in Table I, below:

TABLE I

| Run No. | Wire | Aqueous Dipping Solution % = by weight in $H_2O$ | pH[1] |
|---|---|---|---|
| 1 | Bekaert | 1% glycine | 6.2 (as is) |
| 2 | Bekaert | 1% glycine | 7.4 |
| 3 | Bekaert | 1% glycine | 8 |

TABLE I-continued

| | | | |
|---|---|---|---|
| 4 | Bekaert | 1% glycine | 9 |
| 5 | Bekaert | 1% glycine | 10 |
| 6 | Bekaert | None (control) | — |
| 7 | Enka Z | 1% glycine | 6.2 |
| 8 | Enka Z | 1% glycine | 8 |
| 9 | Enka Z | 1% glycine | 10 |
| 10 | Enka Z | None (control) | — |

| Run No. | Adhesion (N), (Coverage)[2] Unaged | Humid Aged | % Adhesion Change |
|---|---|---|---|
| 1 | 799 (8.5) | 497 (7.5) | −38 |
| 2 | 769 (8.5) | 488 (7) | −37 |
| 3 | 826 (9) | 496 (6.5) | −40 |
| 4 | 830 (8.5) | 513 (7) | −38 |
| 5 | 794 (7.5) | 447 (6.5) | −44 |
| 6 | 733 (6.5) | 454 (6.5) | −38 |
| 7 | 801 (8) | 766 (7.5) | −4 |
| 8 | 834 (8.5) | 703 (8) | −16 |
| 9 | 775 (8) | 625 (7.5) | −19 |
| 10 | 754 (8) | 437 (3) | −42 |

Notes:
[1]pH adjusted with concentrated aqueous ammonia solution.
[2]Coverage - Rubber coverage, 0 = cord bare after being pulled from rubber; 10 = cord completely covered with rubber after being pulled from rubber.

EXAMPLE II

Enka Z brass plated steel wire tire cords (7×4×0.20 mm, 6±2 g brass/kg of wire, 67.5%±3.5% Cu in the brass) were treated for 48 seconds in the dipping solution at toom temperature which was followed by a 40 seconds washing or rinsing step in water at room temperature and further followed by a 110 seconds drying step in air at 177° C. The treated cords were cooled and then combined with the rubber compound as shown above, except that 3.75 parts by weight of "Crystex" (80% sulfur in mineral oil, Stauffer Chem.) were used in place of 3 parts by weight of Rubbermakers Sulfur. Curing was conducted at 153° C. for 35 minutes. The details of the runs and the results obtained are shown in Table II, below:

TABLE II

| Run No. | Aqueous Dipping Solution % = by weight in $H_2O$ | pH[1] |
|---|---|---|
| 11 | None (control) | — |
| 12 | 2% ammonium acetate | 8 |
| 13 | 1% sodium lauroyl sarcosinate | 7.8 (as is) |
| 14 | 1% sarcosine | 11.2 (as is) |
| 15 | 1% ethylenediamine tetraacetic acid | 8 |
| 16 | 1% ethylenediamine tetraacetic acid disodium salt dihydrate | 5.4 (as is) |
| 17 | 1% ethylenediamine tetraacetic acid disodium salt dihydrate | 8 |
| 18 | 1% iminodiacetic acid | 2.6 (as is) |
| 19 | 1% iminodiacetic acid | 8 |
| 20 | 1% nitrilotriacetic acid | 8 |
| 21 | 1% disodium salt of nitrilotriacetic acid | 8 |
| 22 | 1% glycine | 7 |
| 23 | 0.1% $NH_3$ | 10.9 |
| 24 | None (control) | — |

| Run No. | Adhesion (N), (Coverage)[2] Unaged | Humid Aged | % Adhesion Change |
|---|---|---|---|
| 11 | 677 (7) | 496 (1) | −27 |
| 12 | 807 (7.5) | 805 (8) | −3 |
| 13 | 733 (7.5) | 553 (1) | −23 |
| 14 | 806 (7.5) | 738 (3) | −8 |
| 15 | 833 (7.5) | 740 (4) | −11 |
| 16 | 326 (1) | 181 (0) | −45 |
| 17 | 727 (5) | 508 (0) | −30 |
| 18 | 485 (3) | 412 (0) | −15 |
| 19 | 802 (6.5) | 770 (2) | −4 |
| 20 | 872 (7) | 733 (3) | −16 |
| 21 | 833 (7.5) | 429 (1) | −49 |
| 22 | 858 (7.5) | 811 (7.5) | −5 |

TABLE II-continued

| | | | |
|---|---|---|---|
| 23 | 717 (7) | 650 (4) | −9 |
| 24 | 697 (6.5) | 493 (1) | −29 |

EXAMPLE III

Bekaert brass plated steel wire tire cords (7×4×0.2 mm, 6±2 g brass/kg of wire, 67.5%±3.5% Cu in th brass) were treated for 48 seconds in the dipping solution at room temperature which was followed by a 4 seconds washing or rinsing step in water at room temperature and further followed by a 110 seconds drying step in air at 177° C. The treated cords were cooled an then combined with the rubber compound as show above, except that 3.75 parts by weight of "Crystex (80% sulfur in mineral oil, Stauffer Chem.) were used i place of 3 parts by weight of Rubbermakers Sulfur Curing was conducted at 153° C. for 35 minutes. Th details of the runs and the results obtained are shown i Table III, below:

TABLE III

| Run No. | Aqueous Dipping Solution % = by weight in $H_2O$ | pH[1] |
|---|---|---|
| 25 | None (control) | — |
| 26 | 1% ammonium acetate | 8 |
| 27 | 1% sodium lauroyl sarcosinate | 7.8 (as is) |
| 28 | 1% sarcosine | 11.2 (as is) |
| 29 | 1% ethylenediamine tetraacetic acid | 8 |
| 30 | 1% ethylenediamine tetraacetic acid disodium salt dihydrate | 5.4 (as is) |
| 31 | 1% ethylenediamine tetraacetic acid disodium salt dihydrate | 8 |
| 32 | 1% iminodiacetic acid | about 2.6 (as is) |
| 33 | 1% iminodiacetic acid | 8 |
| 34 | 1% nitrilotriacetic acid | 8 |
| 35 | 1% disodium salt of nitrilotriacetic acid | 8 |

| Run No. | Adhesion (N), (Coverage)[2] Unaged | Humid Aged | % Adhesion Change |
|---|---|---|---|
| 25 | 966 (8.5) | 229 (0) | −76 |
| 26 | 1002 (8.5) | 341 (5) | −66 |
| 27 | 1020 (8.5) | 241 (2) | −76 |
| 28 | 826 (7) | 242 (2) | −71 |
| 29 | 743 (6.5) | 197 (0) | −73 |
| 30 | 726 (7) | 153 (0) | −79 |
| 31 | 737 (6) | 198 (0) | −73 |
| 32 | 702 (4.5) | 171 (0) | −76 |
| 33 | 679 (6) | 233 (1) | −66 |
| 34 | 673 (6) | 238 (1) | −65 |
| 35 | 675 (6) | 201 (0) | −78 |

The treatments were generally not as effective wit the Bekaert cord as with the Enka cord which may b due to different inhibitor and/or lubricant residues o the Bekaert cord.

I claim:

1. The method which comprises dipping brass plate steel cord in an aqueous solution consisting essentiall of from about 0.5 to 6% by weight of an amino carbo ylic acid having from 2 to 24 carbon atoms, from 1 to nitrogen atoms and from 1 to 6 carboxylic acid grou and their corresponding ammonium, lithium, sodiu and potassium salts and salt hydrates and mixtures of th same for a time and at a temperature sufficient to r move at least an appreciable amount of the corrosio products on the outer surface layers of said cord an drying the same.

2. The method according to claim 1 containing th additional step of washing said solution treated cord i vater to remove residual amounts of said solution from aid cord prior to drying the same.

3. The method according to claim 2 where said aque- ›us solution has a pH of from about 7 to 11.5.

4. The method according to claim 3 where said amino :arboxylic acid is glycine.

5. The method according to claim 1 where said amino :arboxylic acid is an aliphatic amino carboxylic acid.

6. The method according to claim 1 containing the ıdditional step of combining said dried cord with a 'ulcanizable rubber compound and vulcanizing the ame.

7. The method according to claim 2 containing the .dditional step of combining said dried cord with a 'ulcanizable rubber compound and vulcanizing the ame.

8. The method according to claim 3 containing the dditional step of combining said dried cord with a vulcanizable rubber compound and vulcanizing the same.

9. The method according to claim 4 containing the additional step of combining said dried cord with a vulcanizable rubber compound and vulcanizing the same.

10. The method according to claim 5 containing the additional step of combining said dried cord with a vulcanizable rubber compound and vulcanizing the same.

11. The product produced by the method of claim 1.
12. The product produced by the method of claim 2.
13. The product produced by the method of claim 3.
14. The product produced by the method of claim 4.
15. The product produced by the method of claim 5.
16. The product produced by the method of claim 6.
17. The product produced by the method of claim 7.
18. The product produced by the method of claim 8.
19. The product produced by the method of claim 9.
20. The product produced by the method of claim 10.

* * * * *